US005159908A

United States Patent [19]

Eyermann et al.

[11] Patent Number: 5,159,908

[45] Date of Patent: Nov. 3, 1992

[54] CRANKING DEVICE FOR INTERNAL COMBUSTION ENGINES

[75] Inventors: Manfred Eyermann, Illingen; Josef Weigt, Vaihingen/Enz, both of Fed. Rep. of Germany

[73] Assignee: Robert Bosch GmbH, Stuttgart, Fed. Rep. of Germany

[21] Appl. No.: 634,222

[22] PCT Filed: Jun. 23, 1989

[86] PCT No.: PCT/DE89/00412

§ 371 Date: Dec. 28, 1990

§ 102(e) Date: Dec. 28, 1990

[87] PCT Pub. No.: WO90/02260

PCT Pub. Date: Mar. 8, 1990

[30] Foreign Application Priority Data

Aug. 19, 1988 [DE] Fed. Rep. of Germany ..... 3828165
Jan. 24, 1989 [DE] Fed. Rep. of Germany ..... 3901953

[51] Int. Cl.[5] ..... F02N 11/08
[52] U.S. Cl. ..... 123/179.1; 290/38 R
[58] Field of Search ..... 123/179 R, 179 B, 179 M; 290/38 R, 48

[56] References Cited

U.S. PATENT DOCUMENTS 2,353,900 7/1944 Janes ..... 290/38 R
2,429,388 10/1947 Buxton ..... 290/38 R

FOREIGN PATENT DOCUMENTS 688395 2/1940 Fed. Rep. of Germany .
1563072 4/1970 Fed. Rep. of Germany .

OTHER PUBLICATIONS

Patent Abstracts of Japan, vol. 10, No. 295 (M-523)(2351) Oct. 7, 1986 & JP-A-61-108870.
Patent Abstracts of Japan, vol. 11, No. 397 (M-655)(2844) Dec. 25, 1987 & JP-A-62-162772.

*Primary Examiner*—Andrew M. Dolinar
*Attorney, Agent, or Firm*—Michael J. Striker

[57] ABSTRACT

A cranking device for internal combustion engines includes a permanently excited cranking motor and an electrical run-down brake, having a switching device (25) which, during the run-down phase of the cranking device, connects the connecting leads of the brushes (4, 4') of the cranking motor (1) to one another via a resistor (24). An additional winding of the engaging relay (15) of the cranking device is used as the resistor.

15 Claims, 7 Drawing Sheets

CRANKING DEVICE FOR INTERNAL COMBUSTION ENGINES

PRIOR ART

The invention relates to a cranking device for internal combustion engines and comprising a permanently excited cranking motor and a run-down brake.

Cranking devices of this kind are known. They have the disadvantage, particularly in the case of a rapid starting succession, that although the starter pinion disengages in good time from the associated gear of the internal combustion engine, it does not come to a stop rapidly enough, with the result that the subsequent meshing procedure cannot proceed correctly, and the starter pinion does not mesh correctly in the associated gear of the internal combustion engine. This results in a high mechanical loading of the gears and severe noise generation. Starters are known in which, on completion of the starting procedure, the meshing mechanism or the armature is pressed against a buffer disc or brake disc by a return spring, resulting in a frictional force which shortens the run-down phase of the cranking motors. A disadvantage of this run-down brake is its wear. In addition, abrasion residues can impair the functions of the cranking device. Furthermore, a constant friction or braking torque cannot be achieved due to dirt and any moisture which may penetrate.

SUMMARY OF THE INVENTION

The object of the invention is a cranking device in which even in the case of a rapid starting succession, an optimum meshing operation is guaranteed, with the result that mechanical loads and noises, whatever disturbances of electrical and/or electronic loads connected to the vehicle electrical system, are reduced to a minimum. The object of the invention is achieved by providing an electric run-down brake with a switching device which brakes the cranking motor after the starting procedure, by connecting the connecting leads of the brushes of the cranking motor to one another via an impedance element. It is particularly advantageous here that braking occurs without mechanical intervention in the cranking motor. The run-down brake is therefore very hard-wearing and maintenance-free. Furthermore, a uniform friction or braking torque is guaranteed.

In a preferred embodiment, the brushes of the cranking device are connected to one another via a brake winding which is provided as an additional winding to the excitation winding of an engaging relay. The run-down brake is therefore particularly simple and economical in construction because no additional components are required.

In a further preferred illustrative embodiment, the brake winding is of bifilar design so that no forces act on the armature of the engaging relay in the run-down phase of the cranking motor.

In a further embodiment, the brushes of the motor of the cranking device are connected to one another via a wire jumper. Due to the low resistance of this connection, the cranking motor comes to a stop particular quick. Admittedly, very high currents also flow in this case.

Furthermore, preferred is an embodiment of the cranking device in which the switching device has a changeover contact which is actuable by the engaging relay of the cranking device and, during the run-down phase of the cranking motor, connects the feed lines of the brushes to one another via an impedance element. In this way, a particularly simple construction of the switching device is guaranteed.

In a further preferred illustrative embodiment, the contact bridge of an engaging relay of a cranking device is used as changeover contact, which, in a first position, during the starting phase, connects the cranking motor to a voltage supply and, in a second position, during the run-down phase of the cranking motor, connects the brushes of the latter to a resistor. The advantage of this construction is that existing contacts are used for the switching device, as a result of which the construction is very simple.

In a further preferred illustrative embodiment of the cranking device, contacts which are arranged in the magnetic core of the engaging relay are connected to one another electrically via the contact bridge in the rundown phase of the cranking motor, the first contact being arranged directly in the magnetic core and the second contact being arranged in insulated fashion in the magnetic core. One of the contacts is connected to one end of the braking winding. This construction is particularly compact and space-saving.

Preferably the arrangement is such that, on its side associated with the first and second contact, the contact bridge has a resistance-material arrangement. Accordingly, in the run-down phase of the cranking device, the connecting leads of the brushes of the cranking motor are connected to one another via this resistance-material arrangement. A carbon resistor, in particular a carbon film resistor or, alternatively, a metallic resistor, in particular a metallic resistor strip, can preferably be used. In either case, the arrangement is particularly space-saving since double utilization of the contact bridge is effected, in that, with its one resistance-free side, it initiates the starting procedure of the cranking motor and, in the run-down phase, assumes the braking function of the cranking motor with its other, resistive side.

However, according to a further embodiment, it is additionally or alternatively also possible for a diode to be situated in the circuit containing the first and second contact. In the run-down phase, the current generated by the generator effect of the cranking motor can then flow via the diode. Preferably the arrangement is such that the diode is embedded in the magnetic core in such a way that its one terminal is connected to the magnetic core while its other terminal interacts with the contact surface. This arrangement is not only space-saving but also results in excellent heat dissipation, with the result that the diode remains free from thermal overload.

According to a further embodiment, a special protective resistor which is arranged in the housing of the engaging relay can also be situated in the circuit bridging over the brushes during the run-down phase of the cranking motor. This protective resistor is preferably fixed on the magnetic core or in the switch cover.

According to a further development of the invention it is envisaged that the impedance element is designed as a conductor track arranged on a substrate. Such an arrangement requires only a little space. The conductor track forming the impedance element consists of a material of appropriate conductivity. Its length and width is matched—in conjunction with the material chosen—to the respective starter power.

Preferably, a plurality of conductor tracks are connected in parallel to one another. The conductor tracks can have the same and/or different resistance values.

The arrangement can here be such that the value of the resistance is adjusted by dividing conductor tracks. Due to the connection in parallel, the resistance value increases with the number of conductor tracks divided.

According to a further development of the invention, substrate and conductor tracks are designed as a preferably clad printed circuit board. A printed circuit of this kind leads to an economical and space-saving construction.

The substrate can preferably be designed as a metal plate, in particular an iron plate, which has an insulating layer consisting of glass on which the copper conductor tracks are arranged.

According to another further development, it is envisaged that the substrate is designed as a supporting plate. This can be accommodated inside the engaging relay. Preferably, it is situated in the displacement range of the contact bridge and has the first and second contact with which the contact bridge interacts.

Without having to carry out changes to the engaging relay, the supporting plate can be arranged on one face of the magnetic core of the engaging relay.

It is advantageous here if the supporting plate is held by the first contact, which penetrates the latter with its shank, is fixed to the magnetic core and, with its head, interacts with the contact bridge.

Preferably, the one ends of the conductor tracks start from a first base contact surface, which is connected to the first brush. The other ends of the conductor tracks lead to a second base contact surface, which is connected to the second contact.

To dissipate the waste heat, the supporting plate preferably consists of a thermally conductive, electrically insulating material, in particular ceramics or alumina.

The use of an engaging relay as run-down brake of a cranking device for internal combustion engines has proven particularly advantageous. It has an additional braking winding, which is, for example, provided over the excitation winding and is preferably of bifilar design.

The present invention both as to its construction so to its mode of operation, together with additional objects and advantages thereof, will be best understood from the following detailed description of the preferred embodiments when read with reference to the accompanying drawings.

DESCRIPTION OF THE PREFERRED EMBODIMENTS

Figure 1:
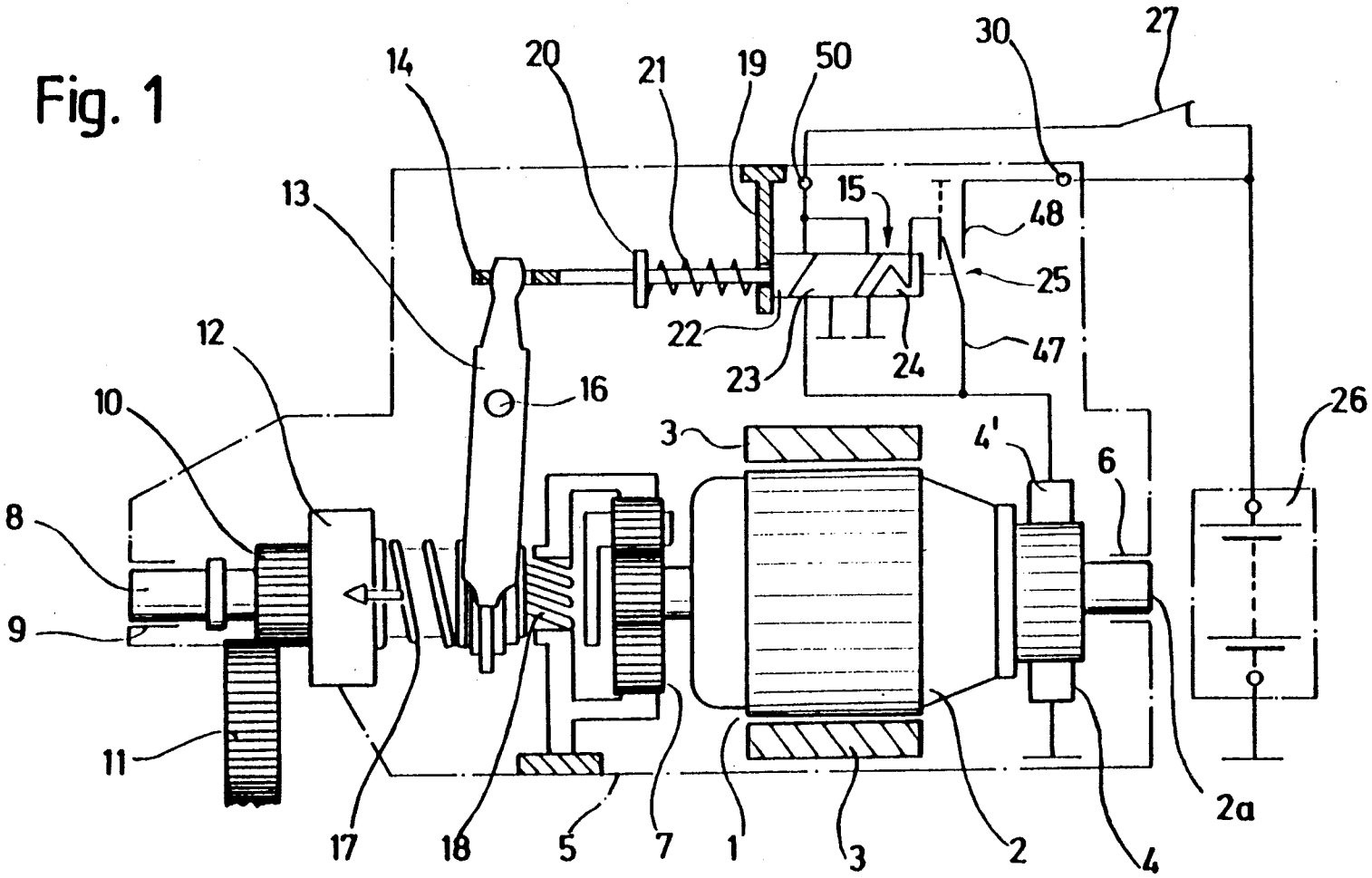
FIG. 1 shows a basic circuit diagram of a cranking device having an electric run-down brake according to the invention.

The schematic sketch according to FIG. 1 shows the construction and electric wiring of a cranking device having an intermediate gear unit. The cranking motor 1 has an armature 2 and permanent magnets 3. A commutator with carbon brushes 4 and 4' is furthermore provided. On the commutator side, the armature shaft 2a has a commutator bearing 6 provided in the housing 5 of the cranking device. A planetary gear unit is provided as intermediate gear unit 7 on the opposite end of the armature shaft 2a. Starting from the intermediate gear unit, the driving shaft 8, which is here held at its forward, left-hand end by an outer bearing 9 provided in the housing 5 of the cranking device. Near to the forward end of the driving shaft is arranged the pinion 10, which can also be designed to project freely. In this figure, the pinion is partially in mesh with a suitable gear, for example the ring gear 11 of an internal combustion engine. Adjoining the pinion 10 on the driving shaft 8 is a roller type overrunning clutch 12. Also arranged on the driving shaft 8 is a first end of an engaging lever 13, the other end of which is held by a driving rod 14 of an engaging relay 15. The engaging lever is pivotably mounted about a swivel joint 16. A meshing spring 17 designed as a helical spring is arranged under stress between the roller type overrunning clutch 12 and the first end of the engaging lever 13. The driving shaft is provided with a coarse thread 18. The engaging relay 15 is attached to the housing 5 of the cranking device by a suitable mounting 19. A return spring 21 designed as a helical spring is clamped between a suitable projection 20 on the driving rod 14 and the mounting 19.

In addition to a pull-in winding 22, the engaging relay 15 has a hold-in winding 23. Both windings are connected by one end to a terminal 50. The hold-in winding 23 is connected by its other end to the ground, and the pull-in winding 22 is connected to the first brush 4'. The second brush 4 is connected directly to the ground. The engaging relay is here provided with a third winding, the brake winding 24, which acts as braking resistor and one end of which is likewise connected to the ground. The other end of the brake winding 24 is associated with a switch 25 which, in the rest position, connects this end electrically to the first brush 4'. The switch 25 is actuated by the engaging relay 15. In its working position, the second end of the braking winding 24 is separated from the first brush 4', this being connected instead, via a terminal 30, to the positive terminal of a voltage supply, for example the battery 26 for the vehicle electrical system. The other end of the battery is connected to the ground.

To initiate a starting procedure, the terminal 50 is connected to the positive terminal of the voltage supply via a starting switch 27, which is designed as a normally open contact. The pull-in and hold-in winding 22, 23 of the engaging relay 15 are thereby also connected to voltage. FIG. 1 shows the beginning of the meshing or starting procedure.

In the excited condition of the engaging relay 15, the driving rod 14 is moved to the right by the engaging relay 15, against the thrust of the return spring 21. As a result, the engaging lever 13 pivots in the clockwise direction about the swivel joint 16 so that the pinion 10 meshes with the ring gear 11.

The excitation of the engaging relay 15 simultaneously actuates the changeover contact 25, with the result that the full voltage of the vehicle electrical system is applied to the first brush 4' and the cranking motor 1 starts up.

At the end of the starting procedure, the starting switch 27 is opened, so that the engaging relay 15 is deenergized. The driving rod 14 is moved to the left in FIG. 1 by the return spring 21, with the result that the engaging lever 13 rotates in the anticlockwise direction about the swivel joint 16, and the pinion 10 is disengaged.

Upon deactivation of the engaging relay 15, the changeover contact 25 is also actuated, i.e. the first brush 4' is separated from the voltage supply. At the same time, it is connected to one end of the brake winding 24, the other end of which, like the second brush 4, is connected to the ground. This means, therefore, that the brushes 4 and 4' are connected to one another via the brake winding 24 acting as a braking impedance element.

FIG. 1 illustrates in dash-dotted lines that the brushes can also be connected directly via a wire jumper.

The current produced during the running down of the permanently excited cranking motor 1 thus flows through the brushes 4 and 4' and through the braking winding 24. A braking force is thereby exerted on the running-down armature 2 of the cranking motor 1, with the result that the latter comes rapidly to a stop. During the running down of the armature 2 of the cranking motor 1, the voltage present at the brushes falls from the initial value of, for example, 12 V to 0 V. The smaller the resistance value of the braking circuit acting as braking impedance element, the greater is the braking force acting on the running-down armature 2. Admittedly, the current flowing through the braking resistor also rises. In order to prevent the generator current taken off by the brushes 4 and 4', which is guided through the brake winding, causing the driving rod 14 to execute a movement, the brake winding has a bifilar design.

It is self-evident that the run-down behaviour of the armature 2 of the cranking motor 1 of the cranking device can be predetermined within a wide range by the choice of the internal resistance of the braking winding. However, consideration must be given to the fact that, in the case of a small internal resistance of the brake winding, a relatively high mechanical/electrical loading of the brushes and of the commutator is also to be expected.

Figure 2:
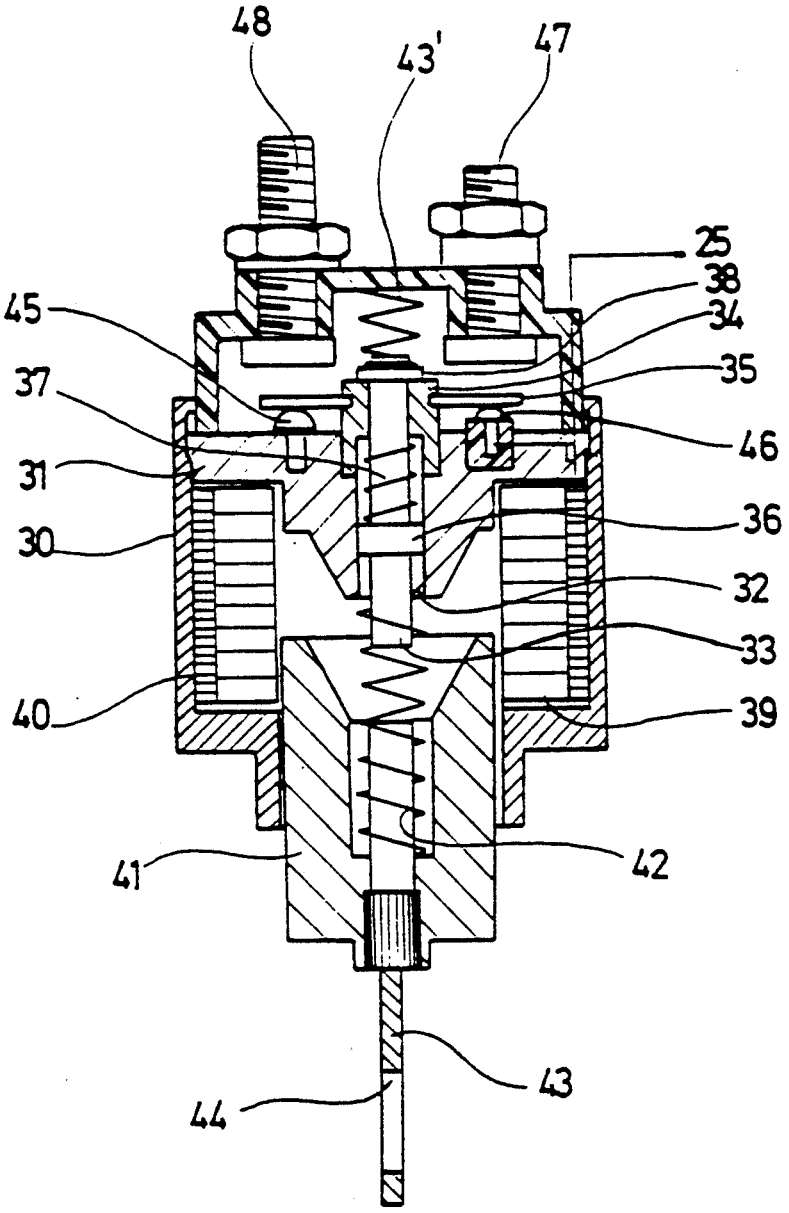
FIG. 2 shows a cross-sectional view of an engaging relay employed in the cranking device according to FIG. 1.

FIG. 2 shows a schematic cross-sectional view of an engaging relay.

It has a magnetic core 31, which is accommodated in a housing 30 and is provided with a central opening 32. Arranged movably in the latter is a switch shaft 33, to one end of which, by a bush 34, a contact bridge 35 is attached. A contact pressure spring 37 is arranged under stress between a shoulder 36 on the switch shaft 33 and the bush 34. A retention disc 38 prevents the bush 34 from being pushed off the switch shaft 33 by the contact pressure spring 37.

The excitation coil 39, comprising pull-in and hold-in winding, is provided around the central axis of the switch shaft 33 in the housing 30 of the engaging relay. The brake winding 40, which is of bifilar design, is applied here to the outside of the excitation winding. The braking winding can of course also be provided on the inside of the excitation winding.

The armature 41 of the engaging relay is arranged movably inside the excitation winding 39. In the unexcited condition of the relay, it is held at a distance from the magnetic core 31 by a first return spring 42. Mounted in the armature 41, concentrically to the central axis of the latter, is a driving rod 43 which, at its end facing away from the armature 41, has an opening 44 into which one end of the engaging lever 13 illustrated in FIG. 1 can be introduced.

The switch shaft 33 is pressed against the magnetic core 31 by a second return spring 43', with the result that the contact bridge 35 is brought into contact with a first contact 45, which is mounted directly in the magnetic core 31 or is produced at that point by the extrusion method, and a second contact 46, which is secured in insulated fashion in the magnetic core 31.

The first contact 45 is connected to the ground, i.e. is connected to the second brush 4. The second contact 46, which is mounted in insulated fashion, is connected to the braking impedance element, to one end of the braking winding 40, the second end of which is associated in FIG. 1 with the changeover contact 25 illustrated in FIG. 1.

When the excitation winding 39, comprising pull-in and hold-in winding, of the engaging relay is connected to the voltage source via the starting switch 27 shown in FIG. 1, the armature 41 is attracted to the magnetic core 31. The driving rod 43 is extended within the armature 41 in such a way that, during this movement of the armature 41, it strikes against the switch shaft 33 and displaces the latter inside the magnetic core 31. As a result, the contact bridge 35 is raised from the first contact 45 and from the second contact 46 and brought into contact with two terminal studs 47 and 48, of which one is connected to the voltage source and the other is connected to the first brush 4' of the cranking motor 1 according to FIG. 1. As a result, the cranking motor turns; the starting procedure is initiated.

At the end of the starting procedure, the starting switch 27 shown in FIG. 1 is opened, the excitation winding 39 thus being de-energized. As a result, the armature 41 is forced away from the magnetic core 31 by the first return spring 42. The second return spring 43' can now move the switch shaft 33 and the contact bridge 35 back into their original position. As a result, the contact bridge 35 establishes an electrically conducting connection between the first contact 45 and the second contact 46, the first brush 4' and the second brush 4 of the cranking motor 1 thus being connected via the brake winding 40 acting as braking impedance element. During the run-down phase, the generator current produced during the rotation of the cranking motor 1 is conducted away via the brushes 4' and 4 through the braking winding 40. A force which counteracts the rotation of the armature 2 is thereby produced, with the result that the run-down phase of the cranking motor is shortened.

From what has been said above, it is readily apparent that a very effective run-down brake is produced with the aid of the braking impedance element designed as a braking winding 40, said brake ensuring a very short run-down phase without mechanical intervention in the starter motor. The pinion 10 can engage without problems in the ring gear 11 of the internal combustion engine, even in the case of a rapid succession of starting procedures. By virtue of the fact that the run-down brake described here acts electrically, a friction or braking torque independent of dirt and moisture penetrating into the cranking device is achieved.

Figure 3:
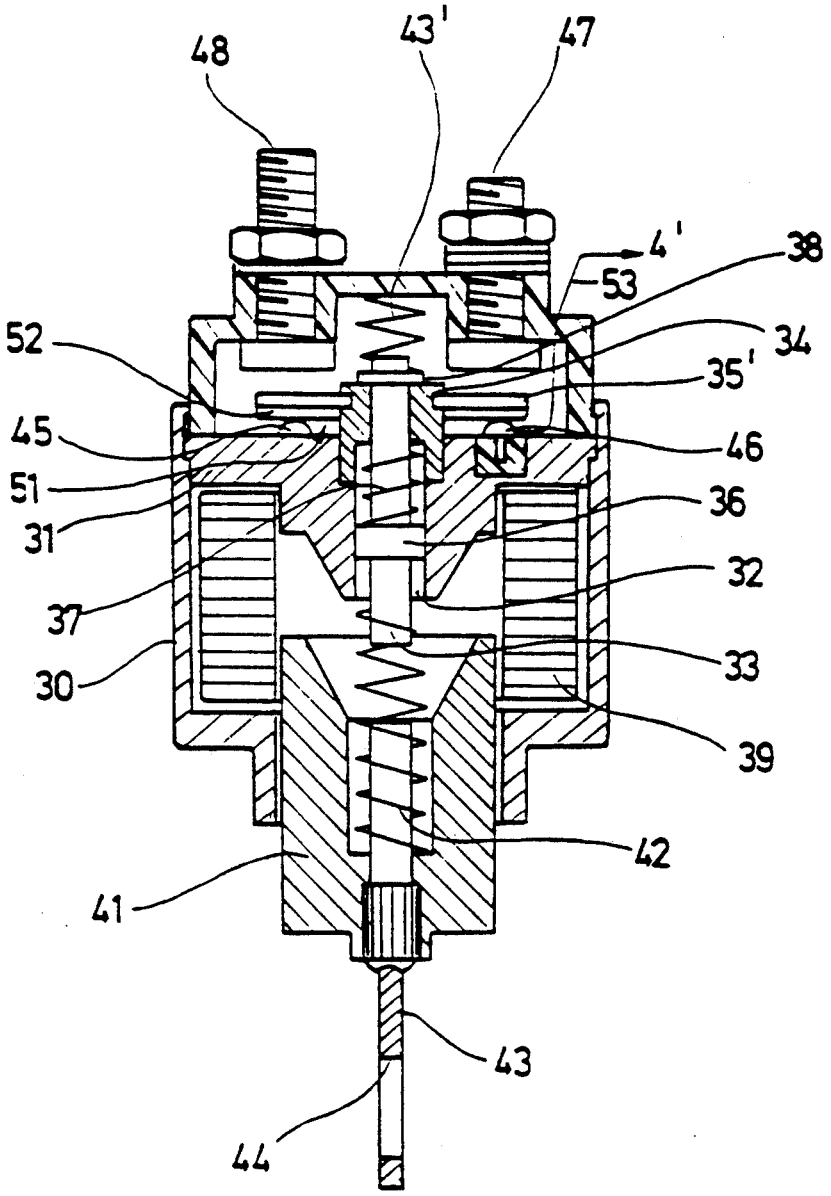
FIG. 3 shows a cross-sectional view of an engaging relay having a contact bridge provided with a resistive coat.
Figure 4:
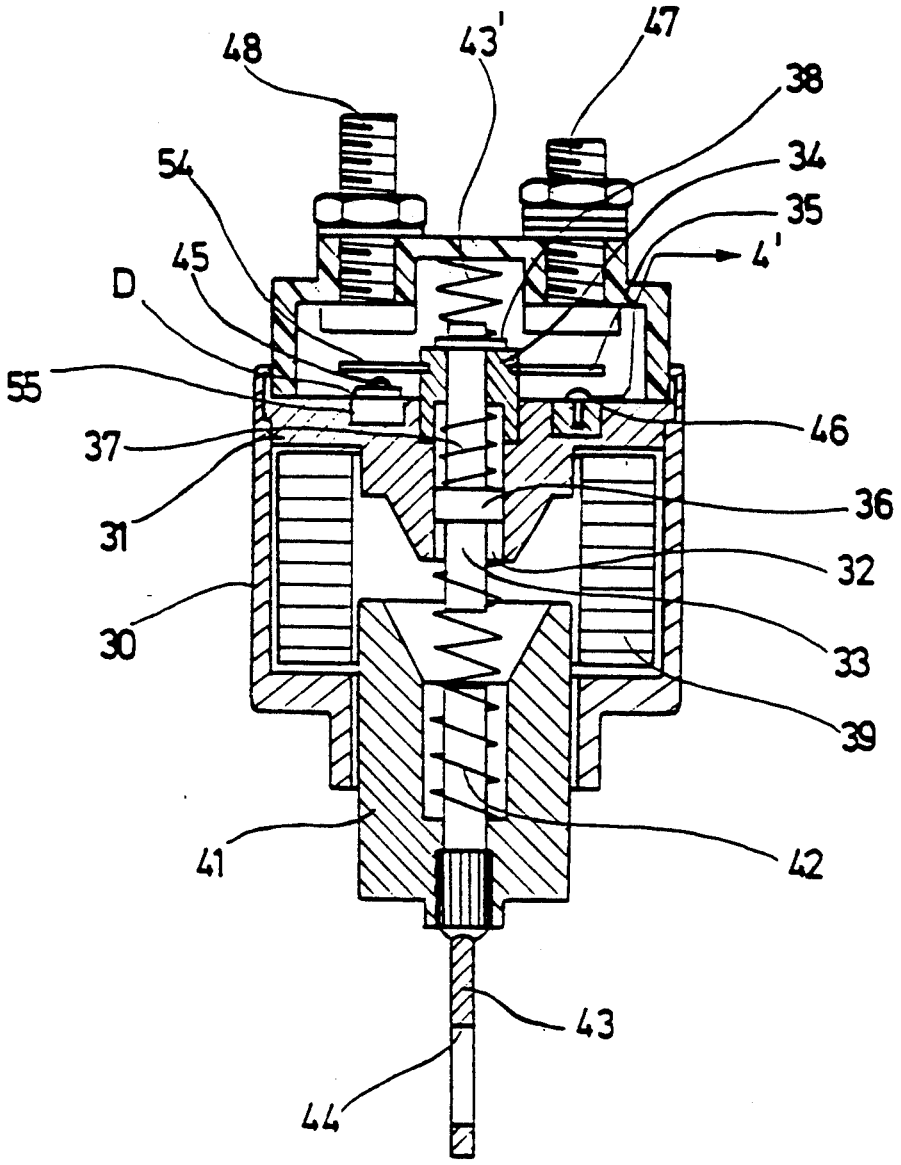
FIG. 4 shows a cross-sectional view of an engaging relay having a diode arranged in the magnetic core.
Figure 5:
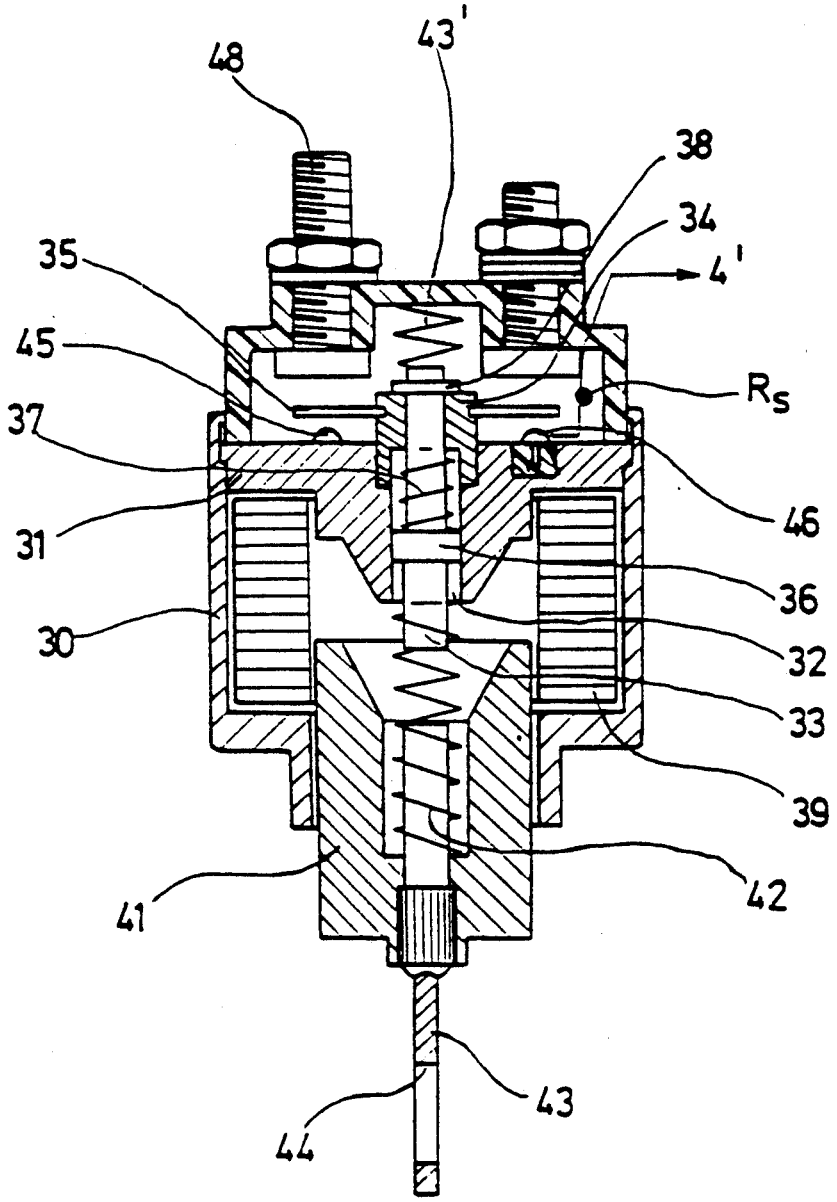
FIG. 5 shows a cross-sectional view of an engaging relay provided with a protective resistor.

Further embodiments of the engaging relay are illustrated in FIGS. 3, 4 and 5. Insofar as there is identity with the illustrative embodiment of FIG. 2, the same reference numerals are used for identical parts.

In the case of the embodiment of FIG. 3, the engaging relay illustrated there is provided with a contact bridge 35' which is provided with a resistance-material arrangement 52 on its side 51 facing the first and second contact 45 and 46. This resistance-material arrangement 52 can preferably be designed as a carbon resistor, in particular as a carbon film resistor, but alternatively also as a metallic resistor, in particular as a metallic resistor strip. The first contact 45 is connected to earth via the magnetic core 31 and the second, insulated contact 46 is connected to the first brush 4' via a line 53.

If the starting procedure of the cranking device is at an end, the contact bridge 35' comes to rest on the first and second contact 45 and 46, the first brush 4' thereby being connected via the resistance-material arrangement 52 to the ground. The current produced during the run-down phase by the generator effect can thus flow off via the resistance-material arrangement 52, bringing about the corresponding braking effect.

The embodiment according to FIG. 4 is characterized in that the first contact 45 is formed by the terminal 54 of a diode D. The diode D is embedded in the magnetic core 31—in particular for heat dissipation—in such a way that the further terminal 55 is connected to earth. The contact bridge 35 is an embodiment corresponding to the illustrative embodiment of FIG. 2.

During the run-down phase of the driving arrangement, the contact bridge 35 connects the second contact 46, which leads to the first brush 4', to the terminal 54 of the diode D, with the result that the current produced by the generator effect of the cranking motor 1 can flow off to the ground via the diode D.

It is also possible to combine the diode D illustrated in FIG. 4 with a resistance-material arrangement 52 such as that described with reference to the embodiment in FIG. 3.

Finally, the embodiment according to FIG. 5 shows the series connection of a protective resistor $R_S$ and the second contact 46.

Insofar as the run-down phase here begins after the starting procedure, the terminal 4' is connected to the ground via the protective resistor $R_S$, the second contact 46, the contact bridge 35 and the first contact 45. Accordingly, braking of the cranking motor 1 takes place via the protective resistor $R_S$.

Figure 6:
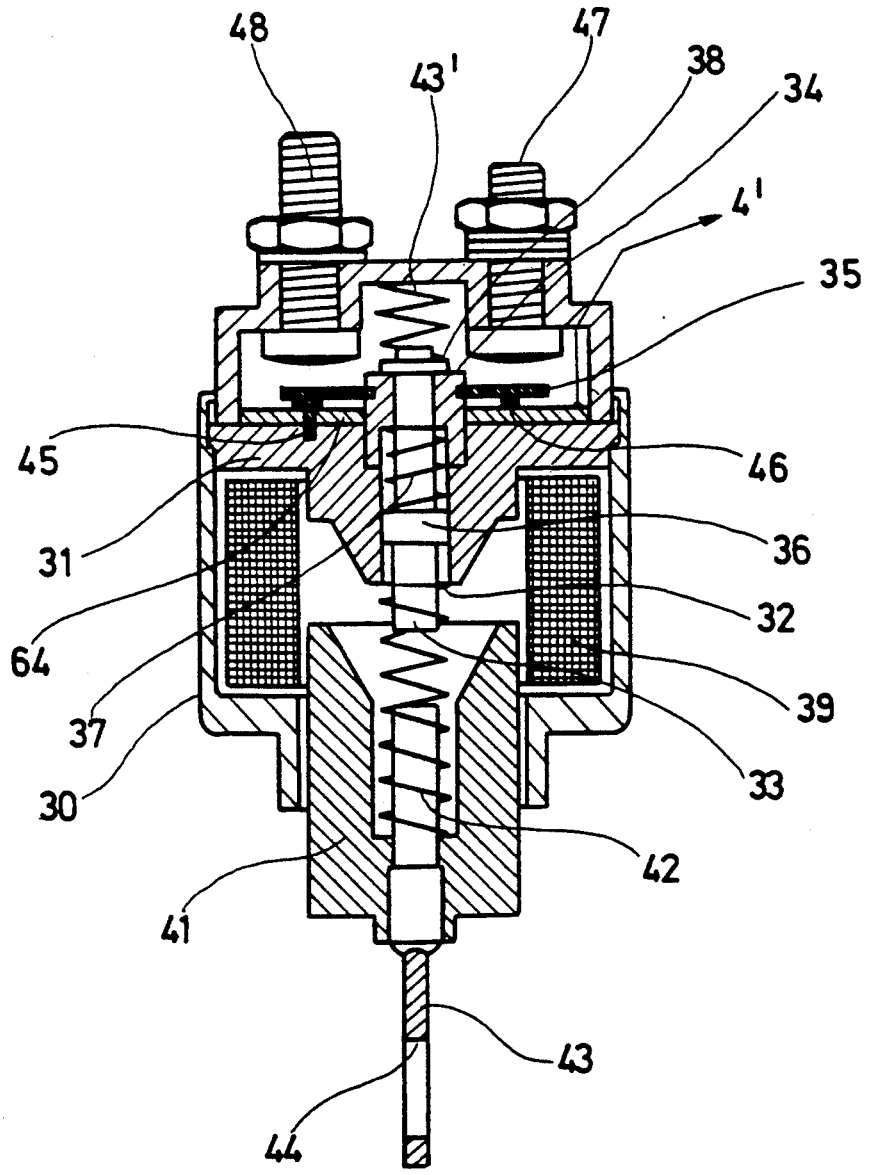
FIG. 6 shows a cross-sectional view of an engaging relay having a clad printed circuit board, the conductor tracks of which form the resistor.
Figure 7:
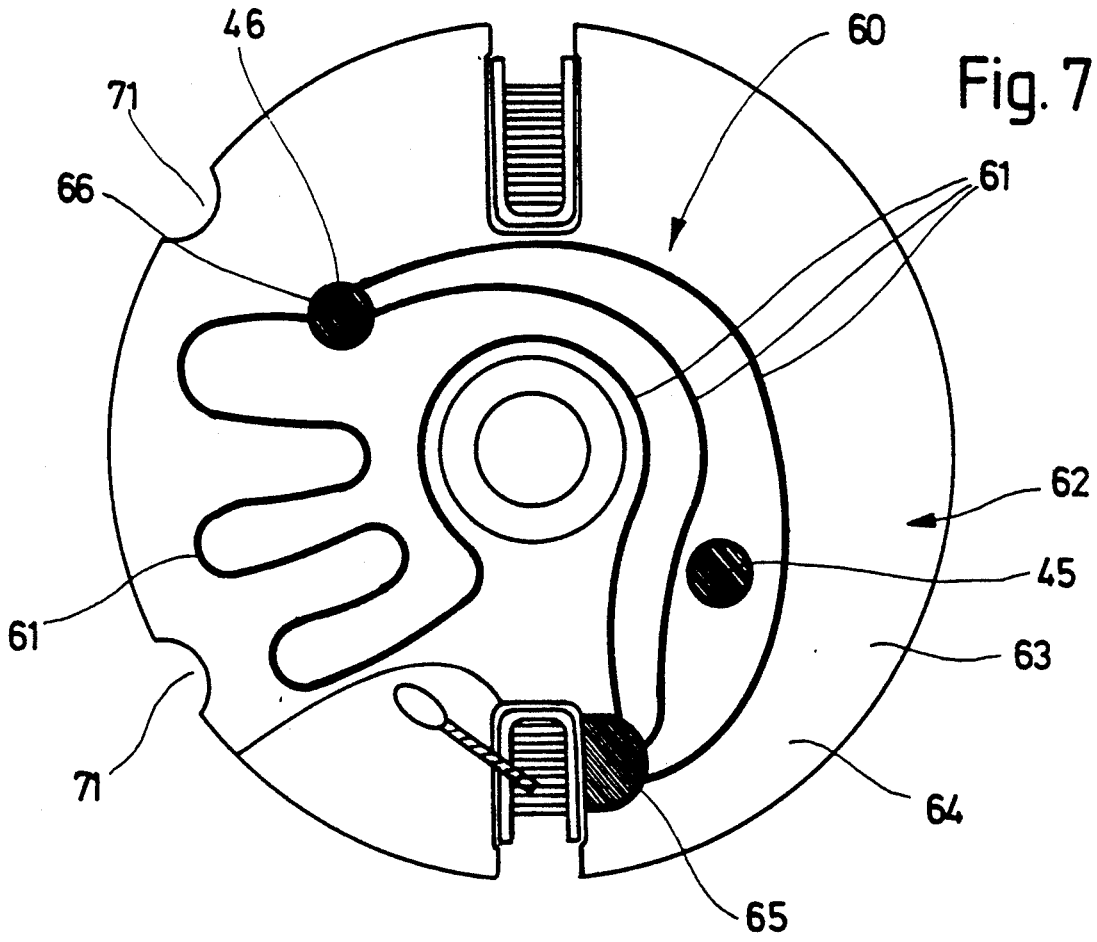
FIG. 7 shows a plan view of the printed circuit board.

FIG. 6 shows a further embodiment. The construction corresponds essentially to that in FIG. 2 and reference is therefore made to the corresponding embodiments. Identical parts are again provided with the same reference numerals. In contrast to the embodiment of FIG. 2, use is made not of a brake winding but of an impedance element 60 which, during the run-down phase of the cranking device, connects the brushes 4 and 4' of the cranking motor 1 to one another. The impedance element 60 is formed by a plurality of conductor tracks 61 connected in parallel, which are arranged on a substrate 62 and have a conductivity appropriate to the field of application. The substrate 62 is preferably a supporting plate 63. It is advantageous, in particular, if substrate 62 and conductor tracks 61 form a clad printed circuit board 64, i.e. the conductor tracks 61 forming the resistor 60 are applied—in a manner corresponding to a printed circuit—to the surface of the supporting plate 63. This is evident, in particular, from FIG. 7.

There it can be seen that the conductor tracks 61, having different lengths, start at one of their ends from a first base contact surface 65, which is connected to the first brush 4' of the cranking motor 1, and with their other ends lead to a second base contact surface 66 which is connected to the second contact 46. Unlike the embodiment of FIG. 2, the second contact 46 is not situated in insulated fashion in the magnetic core 31 of the engaging relay 15 but on the clad printed circuit board 64.

Figure 8:
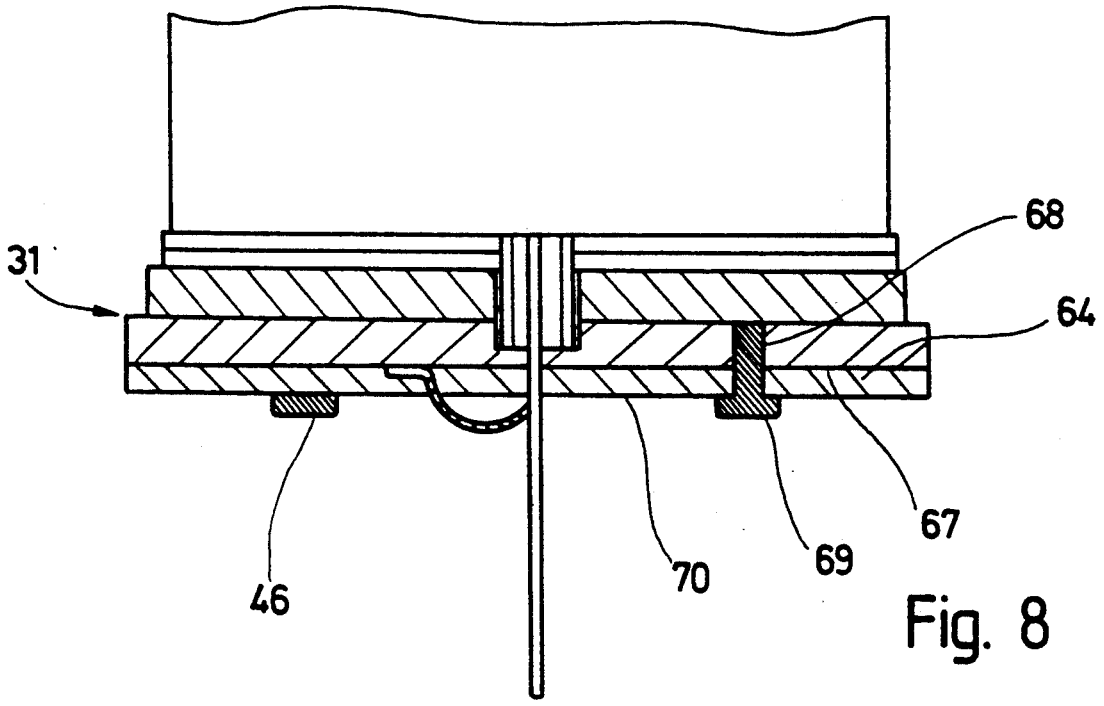
FIG. 8 shows a side view of the printed circuit board arranged in the engaging relay.

It is evident from FIG. 8, in particular, that the printed circuit board 64 is arranged on that face 67 of the magnetic core 31 which faces the contact bridge 35. It is held by the first contact 45, the shank 68 of which passes through the printed circuit board 64, which is fixed to the magnetic core 31 and the head 69 of which fits over the outer side 70 of the printed circuit board 64 and forms the contact surface of the first contact 45.

The printed circuit board 64 can preferably have peripheral recesses 71 which serve for retention secure against rotation inside the engaging relay 1.

In accordance with the embodiment of FIG. 2, the contact bridge 35 is designed as conductor (without a resistance arrangement).

Adjustment of the resistance value of the resistor 60 formed by the conductor tracks 61 can be effected by appropriate severing of conductor tracks 61. The more conductor tracks are severed, the greater the resistance becomes between the first base contact surface 65 and the second base contact surface 66.

During the starting phase, the contact bridge 35 connects the contacts 47 and 48, the battery 26 for the vehicle electrical system thereby being connected to the brushes 4 and 4' of the cranking motor 1. In this phase, the contact bridge 35 occupies its first position. In the run-down phase of the cranking motor 1, the contact bridge 35 is displaced into its second position, in which it connects the first contact 45 to the second contact 46. The first brush 4' is thereby connected via the resistor 60 of the printed circuit board 64 and the contact bridge 35 to the first contact 45, which is connected to the second brush 4. The Resistor 60 accordingly acts as a braking impedance element.

According to a further embodiment (not shown), it is likewise possible to arrange the first contact 45 on the printed circuit board 64 without it passing through it. Accordingly, appropriate retention means for securing the printed circuit board 64 are to be provided and an electrical connection of the first contact 45 to the second brush 4 of the cranking motor 1 has to be effected.

Overall, the clad printed circuit board 64 forms a prefabricated insert which requires only a little space, is simple to install and to produce, and permits shared use of the contact bridge 35. Furthermore, the braking resistance can be chosen by appropriate severing of the conductor tracks 61 in accordance with the starter power. By virtue of the design according to the invention, interference voltages in the vehicle electrical system can furthermore be reduced.

While the invention has been illustrated and described as embodied in a cranking device for internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapted it for various applications without omitting features that, from the standpoint of prior art, fairly constitute essential characteristics of the generic or specific aspects of this invention.

What is claimed as new and desired to be protected by Letters Patent is set forth in the appended claims:

1. A cranking device for internal combustion engine, comprising a permanently excited starter motor having two brushes with respective connecting lines; a switching device having a change-over contact; and an engaging relay for actuating said change-over contact and having a braking impedance element arranged in said engaging relay, said change-over contact being movable between a first position in which it connects during a starting phase of said starter motor, the connecting lines of said two brushes to a voltage supply, and a second position in which it connects, during a rundown phase of said starting motor, the connecting lines of said two brushes to each other via said braking impedance element of said engaging relay.

2. A cranking device as set forth in claim 1, wherein said engaging relay includes a brake winding forming said braking impedance element, and an excitation relay associated with said brake winding.

3. A cranking device as set forth in claim 2, wherein said brake winding has a bifilar design.

4. A cranking device as set forth in claim 2, wherein said switching device includes first and second contacts associated with said two brushes, respectively, said change-over contact being formed as a contact bridge that contact said first and second contacts in a second position of said change-over contact.

5. A cranking device as set forth in claim 4, wherein said contact bridge has resistance-material means on a side thereof facing said first and second contacts.

6. A cranking device as set forth in claim 4, wherein said engaging relay has a magnetic core, said first and second contacts being defined by diode embedded in said magnetic core and having two terminals one of which is connected to said magnetic core and the other of which cooperates with said contact bridge.

7. A cranking device as set forth in claim 4, wherein said engaging relay includes a protective resistor defining said braking impedance element and located between the second contact and a respective one of said two brushes.

8. A cranking device as set forth in claim 4, wherein said engaging relay has at least one conductor track defining said braking resistor, arranged on a substrate and located in a region of said contact bridge.

9. A cranking device as set forth in claim 8, wherein said engaging relay includes a plurality of conductor tracks having different resistance values and arranged parallel to each other, resistance of said braking impedance element being adjusted by disconnecting a number of said conducting tracks.

10. A cranking device as set forth in claim 8, wherein said substrate is formed as a metal plate having an insulating layer on which said at least one conductor track is arranged.

11. A cranking device as set forth in claim 8, wherein said substrate is formed as a carrier plate on which said first and second contacts are arranged.

12. A cranking device as set forth in claim 11, wherein said magnetic core has an end face, said carrier plate being arranged on said end face.

13. A cranking device as set forth in claim 12, wherein the first contact has a shaft penetrating said carrier plate for holding the same, and a head cooperating with said contact bridge.

14. A cranking device as set forth in claim 8, wherein said first and second contacts have first and second contact faces, respectively, said at least one conductor track extending between said first and second contact faces.

15. A cranking device as set forth in claim 11, wherein said carrier plate is formed of a heat-conductive electrically-insulating material selected from a group of materials including ceramics and aluminum oxide.

* * * * *